US011138874B2

(12) United States Patent
Huang et al.

(10) Patent No.: US 11,138,874 B2
(45) Date of Patent: Oct. 5, 2021

(54) TIMING CONTROL METHOD AND APPARATUS FOR SIGNAL LIGHT, ELECTRONIC DEVICE AND STORAGE MEDIUM

(71) Applicant: BEIJING BAIDU NETCOM SCIENCE AND TECHNOLOGY CO., LTD., Beijing (CN)

(72) Inventors: Xuan Huang, Beijing (CN); Fan Yang, Beijing (CN); Hui Yuan, Beijing (CN); Yongyi Sun, Beijing (CN); Chengfa Wang, Beijing (CN); Qiqi Xu, Beijing (CN)

(73) Assignee: BEIJING BAIDU NETCOM SCIENCE AND TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 17/037,421

(22) Filed: Sep. 29, 2020

(65) Prior Publication Data

US 2021/0142663 A1 May 13, 2021

(30) Foreign Application Priority Data

Nov. 13, 2019 (CN) ..... 201911105044.X

(51) Int. Cl.
*G08G 1/01* (2006.01)
*G08G 1/07* (2006.01)

(52) U.S. Cl.
CPC ..... *G08G 1/07* (2013.01); *G08G 1/0129* (2013.01); *G08G 1/0145* (2013.01)

(58) Field of Classification Search
CPC ..... C12Q 1/6851; C12Q 2545/113; C12Q 2537/165; C12Q 2545/101;
(Continued)

(56) References Cited

U.S. PATENT DOCUMENTS 7,973,276 B2 * 7/2011 Cunningham ..... G01V 5/0075 250/252.1
2007/0159107 A1 * 7/2007 Powell ..... H05B 41/38 315/149
(Continued)

FOREIGN PATENT DOCUMENTS

CN 104916142 A 9/2015
CN 104408944 B 8/2016
(Continued)

OTHER PUBLICATIONS

Chinese Patent Application No. 201911105044.X First Office Action dated Aug. 28, 2020, 12 pages.
(Continued)

*Primary Examiner* — Daniel Previl
(74) *Attorney, Agent, or Firm* — Lathrop GPM LLP

(57) ABSTRACT

A timing control method and a timing control apparatus for a signal light, and a storage medium are disclosed. The method includes: determining an optimal passing-through duration of a signal light corresponding to each passing-through direction at a target intersection according to traffic in the passing-through direction; determining a range of values for each variable in a calibration function corresponding to the target intersection according to a constraint to each passing-through direction at the target intersection, wherein the calibration function comprises the optimal passing-through duration corresponding to each passing-through direction and a variable corresponding to a final passing-through duration in each passing-through direction; and calculating the final passing-through duration in each passing-through direction in a case where the calibration function meets a preset condition, according to the range of values for each variable.

20 Claims, 3 Drawing Sheets

(58) Field of Classification Search
CPC ..... C12Q 2545/107; C12Q 1/06; G01B 2290/60; G01B 9/02004; G01B 9/02007; G01B 9/02083; G01B 9/02091; G01B 11/026; G01B 11/14; G01B 9/02; G01B 9/02002; H01S 5/18366; H01S 5/4012; H01S 5/423; H01S 5/426; B01L 7/52; B01L 2300/042; B01L 2300/0858; B01L 2300/1827; B01L 3/508; B01L 9/00; A61B 2560/0214; A61B 2560/0223; A61B 5/002; A61B 5/02055; A61B 5/02116; A61B 5/02141; A61B 5/02225; A61B 5/02241; A61B 5/0261; A61B 5/0533; A61B 5/0816; A61B 5/318; A61B 5/7278; A61B 2560/0406; A61B 2562/0233; A61B 2562/043; A61B 5/0002; A61B 5/01; A61B 5/022; A61B 5/093; A61B 5/12; A61B 5/14552; A61B 5/6816; G01J 1/4219; G01J 1/04; G01J 1/0425; G01J 2001/0481; G01J 3/02; G01J 3/0218; G01J 3/0224; G01J 3/0229; G01J 3/024; G01J 3/0286; G01J 3/10; G01J 3/447; G01J 4/00; G01J 9/00; G01N 2035/00376; G01N 21/251; G01N 21/274; G01N 21/314; G01N 15/0205; G01N 1/38; G01N 2021/213; G01N 2021/3181; G01N 2021/6417; G01N 2021/6419; G01N 2021/6421; G01N 2021/6432; G01N 2021/6439; G01N 2021/6441; G01N 2021/6463; G01N 2021/6471; G01N 2035/00366; G01N 2035/0097; G01N 2035/0405; G01N 21/0332; G01N 21/211; G01N 21/27; G01N 21/278; G01N 21/3151; G01N 21/47; G01N 21/4738; G01N 21/55; G01N 21/59; G01N 21/6428; G01N 21/645; G01N 2201/062; G01N 2201/0627; G01N 23/16; G01N 24/006; G01N 33/4925; G01N 35/0099; G01S 17/36; G01S 13/92; G01S 17/08; G01S 17/10; G01S 17/42; G01S 17/66; G01S 7/4814; G01S 7/4911; G01S 7/4917; G01S 7/497; G06N 20/00; G06N 7/023; G06Q 20/202; H03K 17/74; H03K 17/941; H03K 2217/0027; H03K 2217/0081; H05B 45/38; H05B 45/385; H05B 47/11; H05B 47/125; H05B 47/16; H05B 47/175; B01J 19/0093; B01J 2219/00788; B01J 2219/00873; B01J 2219/00963; B01J 2219/0097; D21G 9/0018; F01K 13/02; F01K 3/22; F22G 5/00; F23N 1/005; F23N 2221/10; F23N 2225/08; F23N 5/18; F28D 2021/0077; F28F 13/00; F41G 9/02; F41J 5/12; G01K 13/20; G01P 5/083; G01R 33/26; G01T 1/115; G02B 5/285; G02F 1/216; G02F 2201/307; G02F 2201/58; G02F 2203/055; G02F 2203/06; G03B 19/18; G03B 21/50; G03B 27/80; G03C 5/02; G03C 5/08; G05B 13/021; G05B 6/05; G05D 23/1913; G06G 7/48; G06G 7/76; G06K 19/06046; G06K 7/12; G07D 7/121; G07F 7/086; G08B 3/10; G08G 1/042; H01H 47/325; H02J 7/0071; H02M 7/5236; H03B 17/00; H03L 5/00; H03L 7/26; H04M 19/02; H04N 1/6022; Y10S 128/905; Y10S 162/10; Y10S 320/21; Y10T 436/12; Y10T 436/2575
USPC ..... 340/917–919, 916, 929, 925, 931, 938, 340/973, 994, 995.13, 995.2
See application file for complete search history.

(56) References Cited

U.S. PATENT DOCUMENTS

| | | | | |
|---|---|---|---|---|
| 2008/0094250 | A1* | 4/2008 | Myr | G08G 1/04 340/909 |
| 2016/0027299 | A1* | 1/2016 | Raamot | G08G 1/08 340/917 |
| 2017/0289511 | A1* | 10/2017 | Usami | H04N 9/3155 |
| 2019/0156134 | A1* | 5/2019 | Krishnan | A61B 5/225 |

FOREIGN PATENT DOCUMENTS

| | | | |
|---|---|---|---|
| CN | 107516426 | A | 12/2017 |
| CN | 108648446 | A | 10/2018 |
| CN | 108932855 | A | 12/2018 |
| CN | 109035808 | A | 12/2018 |
| CN | 109509357 | A | 3/2019 |
| CN | 109872544 | A | 6/2019 |
| JP | 6019932 | B2 | 11/2016 |
| JP | 2019079199 | A | 5/2019 |

OTHER PUBLICATIONS

Chinese Patent Application No. 201911105044.X English translation of First Office Action dated Aug. 28, 2020, 11 pages.
European Patent Application No. 20207085.0 Extended Search and Opinion dated Mar. 30, 2021, 9 pages.

* cited by examiner

TIMING CONTROL METHOD AND APPARATUS FOR SIGNAL LIGHT, ELECTRONIC DEVICE AND STORAGE MEDIUM

CROSS REFERENCE TO RELATED APPLICATION

This application claims priority under 35 U.S.C. § 119(a) to Chinese Patent Application No. 201911105044.X, filed with the State Intellectual Property Office of P. R. China on Nov. 13, 2019, the entire contents of which are incorporated herein by reference.

TECHNICAL FIELD

The present disclosure relates to fields of data processing and intelligent transportation technologies, and more particularly, to a timing control method for a signal light, a timing control apparatus for a signal light, an electronic device and a storage medium.

BACKGROUND

In a field of intelligent transportation, to control timing for a signal light in various communication directions at an intersection, it is usually necessary to consider various constraints, such as pedestrian crossing restrictions. There are more constraints, especially for signal lights installed at complex intersections.

Currently, signal light timing is mostly performed in a manual mode by constantly adjusting and testing according to various constraints to achieve a better traffic state at the intersection.

SUMMARY

In a first aspect, embodiments of the present disclosure provide a timing control method for a signal light. The method includes: determining an optimal passing-through duration of a signal light corresponding to each passing-through direction at a target intersection according to traffic in the passing-through direction; determining a range of values for each variable in a calibration function corresponding to the target intersection according to a constraint to each passing-through direction at the target intersection, wherein the calibration function comprises the optimal passing-through duration corresponding to each passing-through direction and a variable corresponding to a final passing-through duration in each passing-through direction; and calculating the final passing-through duration in each passing-through direction in a case where the calibration function meets a preset condition, according to the range of values for each variable.

In a second aspect, the present disclosure provides a timing control apparatus for a signal light. The apparatus includes: a first determination module, a second determination module, and a computing module. The first determination module is configured to determine an optimal passing-through duration of a signal light corresponding to each passing-through direction at a target intersection according to traffic in the passing-through direction. The second determination module is configured to determine a range of values for each variable in a calibration function corresponding to the target intersection, according to a constraint to each passing-through direction at the target intersection, wherein the calibration function comprises the optimal passing-through duration in each passing-through direction and a variable corresponding to a final passing-through duration in each passing-through direction. The computing module is configured to calculate the final passing-through duration in each passing-through direction according to the range of values for each variable when the calibration function meets a preset condition.

In a third aspect, embodiments of the present disclosure provide an electronic device. The electronic device includes: one or more processors; and a storage device, configured to store one or more programs, wherein, when the one or more programs are executed by the one or more processors, the one or more processors are configured to implement the timing control method for a signal light according to the above embodiments.

In a fourth aspect, embodiments of the present disclosure provide a tangible, non-transitory computer-readable storage medium storing computer instructions, wherein when the computer instructions are executed, the computer is caused to implement the timing control method for a signal light according to the above embodiments.

BRIEF DESCRIPTION OF THE DRAWINGS

The accompanying drawings are used to better understand the solution, and do not constitute a limitation on the present disclosure, in which.

DETAILED DESCRIPTION

The following describes the exemplary embodiments of the present disclosure with reference to the accompanying drawings, which includes various details of the embodiments of the present disclosure to facilitate understanding, which shall be considered merely exemplary. Therefore, those of ordinary skill in the art should recognize that various changes and modifications can be made to the embodiments described herein without departing from the scope and spirit of the present disclosure. For clarity and conciseness, descriptions of well-known functions and structures are omitted in the following description. The method and device for identifying the validity of parking space data according to embodiments of the present disclosure will be described below with reference to the drawings.

A timing control method for a signal light, a timing control apparatus for a signal light, an electronic device, and a storage medium of the present disclosure are described below with reference to the drawings.

In view of the above mentioned background section, in the related art, for the technical problem of long time-consuming, low speed and unguaranteed effect of the timing process during manually of timing signal lights according to the constraint to the intersection, the present disclosure provides a timing control method for a signal light, the final passing-through duration is determined by finding the optimal solution that satisfies the preset conditions for each variable in the calibration function according to the range of values for each variable corresponding to the final passing-through duration in each passing-through direction. Since there is no need for manual timing according to the constraint, the timing result is not affected by artificial subjective factors, and since the processing speed of the computer is much faster than manual processing speed, the technical problem of long time-consuming, low speed and unguaranteed effect of the timing process during manually timing signal lights according to the constraint to the intersection is solved, and then the technical effect of improving the speed and accuracy of the timing of the signal light is achieved.

Figure 1:
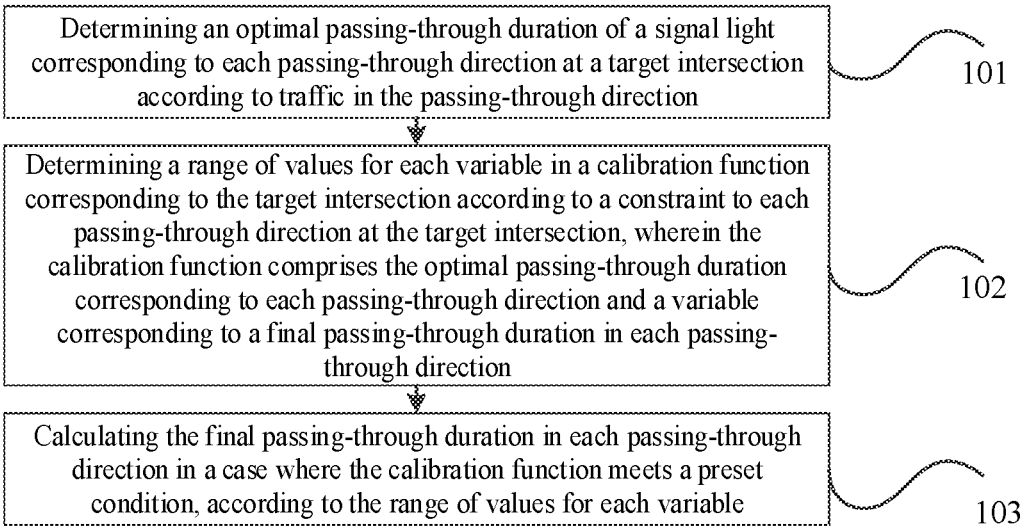
FIG. 1 is a schematic flowchart of a timing control method for a signal light according to a first embodiment of the present disclosure.

In detail, FIG. 1 is a schematic flowchart of a timing control method for a signal light according to a first embodiment of the present disclosure. The method may be executed by a timing control apparatus for a signal light according to the present disclosure, or may be executed by an electronic device, where the electronic device may be a server, or may be a terminal device such as an in-vehicle terminal or a mobile terminal, which is not limited in the present disclosure. The following uses the server to execute the timing control method for a signal light of the present disclosure as an example to describe and explain the present disclosure.

As illustrated in FIG. 1, the timing control method for a signal light includes the following steps.

At step 101, an optimal passing-through duration of a signal light corresponding to each passing-through direction at a target intersection is determined according to traffic in the passing-through direction.

The target intersection may be any intersection to be subjected to signal light timing.

In the embodiment, for the target intersection to be subjected to signal light timing, the traffic at the target intersection in each passing-through direction are obtained, and then the optimal passing-through duration of the signal light corresponding to each passing-through direction can be determined according to the acquired traffic. The traffic in each passing-through direction may include the number of vehicles traveling through the passing-through direction and the number of pedestrians. The number of vehicles includes, but is not limited to, non-automatic vehicles such as motor vehicles, electro-mobiles, and bicycles.

In detail, when the traffic of the target intersection in each passing-through direction is acquired, surveillance video of the target intersection can be acquired from the surveillance camera of the target intersection. For the traffic in each passing-through direction, through vehicle recognition and/or face recognition of vehicles and/or pedestrians traveling in various passing-through directions in the surveillance video, the number of vehicles and the number of pedestrians identified in each passing-through direction are counted to determine the traffic in each passing-through direction. Face recognition is only performed on pedestrians who are not riding or driving any vehicles to ensure the accuracy of the recognition results.

Next, after acquiring the traffic at the target intersection in each passing-through direction, the optimal passing-through duration of the signal light corresponding to each passing-through direction may be determined according to the acquired traffic.

For example, Webster's single-point timing algorithm may be used to determine the optimal passing-through duration based on the traffic in each passing-through direction. The Webster single-point timing algorithm is a relatively mature existing algorithm, and its principle and timing method are not described in detail in this disclosure. Certainly, other algorithms can also be used to determine the optimal passing-through duration in each passing-through direction. The Webster single-point timing algorithm is only used as an example, which is not limited in this disclosure.

Signal light timing is usually timing of signal lights in a future period. Since the future period has not yet appeared, it is impossible to obtain the traffic in each passing-through direction at the target intersection in the future period, so it is also impossible to determine the optimal passing-through duration of the signal light in each passing-through direction in the next time period. In response to this problem, the present disclosure provides two different solutions to determine the optimal passing-through duration of the signal light corresponding to the next time period, which are introduced separately below.

In a possible implementation, determining the optimal passing-through duration of the signal light corresponding to each passing-through direction according to the traffic in each passing-through direction at the target intersection includes: determining the optimal passing-through duration of the signal light corresponding to each passing-through direction during a next time period adjacent to the current time period according to the traffic at the target intersection in each passing-through direction during the current time period.

Generally, the traffic at the same intersection in the adjacent period does not change significantly. Therefore, in the embodiments of the present disclosure, the traffic in each passing-through direction at the target intersection in the current time period can be obtained to roughly reflect the traffics in the same passing-through direction in the next time period, and then according to the current traffic in each passing-through direction, the optimal passing-through duration of the signal light corresponding to each passing-through direction in the next time period adjacent to the current time period is determined. For example, the Webster single-point timing algorithm is applicable for determining the optimal passing-through duration.

In a possible implementation, determining the optimal passing-through duration of the signal light corresponding to each passing-through direction according to the traffic in each passing-through direction at the target intersection includes: determining the optimal passing-through duration of the signal light corresponding to each passing-through direction during a next time period adjacent to the current time period according to the traffic at the target intersection in each passing-through direction during the current time period.

For the same passing-through direction at the same intersection, the traffic in the passing-through direction at the same time period each day is basically the same. Therefore, in the embodiments of the present disclosure, the historical traffic in each passing-through direction during the next time period are obtained, and then the optimal passing-through duration of the signal light in each passing-through direction during the next time period is determined. For example, the Webster single-point timing algorithm is used to determine the optimal passing-through duration. The historical traffic in each passing-through direction in the next time period can be determined by face recognition and vehicle recognition through the surveillance video during the next time period of the previous N (N is a positive integer) days, or the historical traffic of the next time period can be stored in advance in a server and directly obtained when needed, which is not limited in the present disclosure.

At step 102, a range of values for each variable in a calibration function corresponding to the target intersection is determined according to a constraint to each passing-through direction at the target intersection, in which the calibration function includes the optimal passing-through duration corresponding to each passing-through direction and a variable corresponding to a final passing-through duration in each passing-through direction.

The calibration function is defined in advance. For example, the number of variables is defined first according to the number of passing-through directions at the target intersection, and then the calibration function is defined according to the optimal passing-through duration of the signal light corresponding to each variable and each passing-through direction.

For example, the calibration function is illustrated by equation (1).

$$f = \sum_{i=1}^{n} (p_i - p_{0i})^2, \tag{1}$$

Here, $p_i$ is a variable corresponding to the final passing-through duration in the i-th passing-through direction, which is a solution required to be solved as last; $p_{0i}$ is the optimal passing-through duration of the signal light in the i-th passing-through direction; and n is the number of passing-through directions at the target intersection, which is a positive integer.

In order to ensure the optimal traffic state of the target intersection, when controlling the timing of the signal lights at the target intersection, it is usually necessary to consider various constraints conditions of the target intersection. Therefore, in this embodiment, for the final passing-through duration in each passing-through direction, the range of values for each variable corresponding to the final passing-through duration in each passing-through direction is determined according to the constraint to the passing-through direction.

The constraint to each passing-through direction may include but are not limited to pedestrian crossing constraints, trunk priority constraints, and maximum and minimum green constraints. The constraint to the passing-through direction can be stored in the server in advance, and when signal light timing is required, the constraint to each communication direction are acquired to determine the range of values for each variable according to the constraint.

For different a constraint, the value ranges of the variables are different.

For example, for the direction of the pedestrian crossing constraints, the traffic road for motor vehicles is associated with pedestrian crossing, then the passing-through duration of the passing-through direction is greater than the pedestrian crossing duration to ensure that there is enough time for the pedestrian to pass, then the range of values for the variables corresponding to the final passing-through duration of the passing-through direction is greater than the pedestrian crossing duration.

For example, for the maximum and minimum green constraints, a certain passing-through direction needs to meet preset or objectively existing maximum and minimum green constraints. Experience shows that it takes at least 7 seconds for a car to leave the stop line and enter the next road section, thus the minimum green in each passing-through direction is set to 7 seconds, that is, the range of values for the variable corresponding to the final passing-through duration in each passing-through direction is greater than 7.

At step 103, the final passing-through duration in each passing-through direction in a case where the calibration function meets a preset condition is calculated according to the range of values for each variable.

The preset condition may be set in advance. For example, the preset condition may be a condition in which the value of the calibration function is smallest, or the value of the calibration function is a preset value.

In this embodiment, after the range of values for each variable in the calibration function is determined, an optimization tool is used to calculate the solution of each variable in the calibration function in a case where the calibration function meets the preset conditions, according to the range of values for each variable. The calculated solution of each variable is the final passing-through duration in each passing-through direction. For example, data optimization tools such as MATLAB and CPLEX can be used for solving, and the final passing-through duration in each passing-through direction can be obtained. It is understood that the resulting final passing-through duration of each passing-through direction falls within the range of values for the variables of the passing-through direction.

Through the use of MATLAB, CPLEX and other data optimization tools to determine the final passing-through duration of each passing-through direction, the processing method of manually timing the signal lights according to the constraint in the related art is converted to the computer processing, which increases the processing speed and efficiency, and avoids the influence of artificial subjective factors on timing, so as to improve timing accuracy.

In a possible implementation, the calibration function is used to characterize a degree of difference between the final passing-through duration and the optimal passing-through duration in each passing-through direction, so that the final passing-through duration in each passing-through direction in a case where the calibration function meets a preset condition is calculated. Since the calibration function characterizes the degree of difference between the final passing-through duration and the optimal passing-through duration in each passing-through direction, the difference between the final passing-through duration and the optimal passing-through duration in each passing-through direction may be the smallest when the value of the calibration function is smallest, resulting in a final passing-through duration closest to the optimal passing-through duration, which ensures maximum traffic at the target intersection as much as possible on the basis of satisfying the constraint, and is conductive to alleviating the traffic pressure in all passing-through directions and further improving the accuracy of signal light timing.

Further, in a case where at least two sets of solutions correspond to the minimized value of the calibration function, a solution corresponding to a minimized degree of difference between the final passing-through duration and the optimal passing-through duration in each passing-through direction may be determined as the final passing-through duration in each passing-through direction. Therefore, it is ensured that the final passing-through duration of each passing-through direction is close to the optimal passing-through duration, and the accuracy of signal light timing is further improved.

Furthermore, if any set of the at least two sets of solutions when the calibration function takes a minimum value cannot minimize the difference between the final passing-through duration and the optimal passing-through duration of each passing-through direction, then the set of solutions with the largest number of solutions that minimize the difference between the final passing-through duration and the optimal passing-through duration is determined as the final passing-through duration of each passing-through direction.

With the timing control method for a signal light according to embodiments of the present disclosure, an optimal passing-through duration of a signal light corresponding to each passing-through direction at a target intersection may be determined according to traffic in the passing-through direction. A range of values for each variable in a calibration function corresponding to the target intersection may be determined according to a constraint to each passing-through direction at the target intersection, wherein the calibration function includes the optimal passing-through duration corresponding to each passing-through direction and a variable corresponding to a final passing-through duration in each passing-through direction. A final passing-through duration in each passing-through direction in a case where the calibration function meets a preset condition may be calculated according to the range of values for each variable. Therefore, when it is determined the calibration function satisfies the preset conditions through the calibration function and the range of values for each variable in the calibration function determined according to the constraint, the timing of the final passing-through duration in each passing-through direction may be controlled automatically based on the constraint, since there is no need to manually time the signal lights according to the constraint, labor costs are saved. Since the processing speed of the computer is much faster than manual processing speed, the solution of the present disclosure saves the time cost of signal light timing and improves the timing speed and efficiency, the solution of the present disclosure is not affected by artificial subjective factors. Compared with the manual timing method, it is beneficial to improve the accuracy of signal timing and provides conditions for the realization of intelligent transportation. The final passing-through duration is determined by finding the optimal solution that satisfies the preset conditions for each variable in the calibration function according to the range of values for each variable corresponding to the final passing-through duration in each passing-through direction, since there is no need for manual timing according to the constraint, the timing result is not affected by artificial subjective factors, and since the processing speed of the computer is much faster than manual processing speed, the technical problem of long time-consuming, low speed and unguaranteed effect of the timing process during manually timing of signal lights according to the constraint to the intersection is solved, and then the technical effect of improving the speed and accuracy of the timing of the signal light is achieved.

Figure 2:
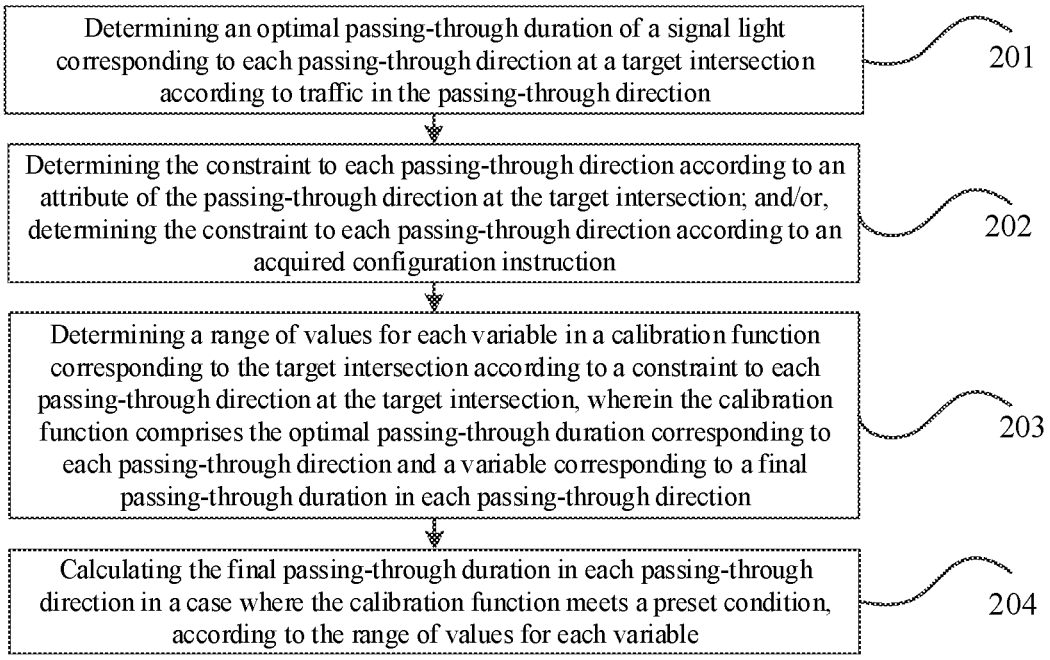
FIG. 2 is a schematic flowchart of a timing control method for a signal light according to a second embodiment of the present disclosure.

FIG. 2 is a schematic flowchart of a timing control method for a signal light according to a second embodiment of the present disclosure. As illustrated in FIG. 2, the timing control method for a signal light includes the following steps.

At step 201, an optimal passing-through duration of a signal light corresponding to each passing-through direction at a target intersection is determined according to traffic in the passing-through direction.

In this embodiment, the description of step 201 reference may be made to the description of step 101 in the foregoing embodiment, and details are not described herein again.

At step 202, the constraint to each passing-through direction are determined according to an attribute of the passing-through direction at the target intersection; and/or, determined according to an acquired configuration instruction.

The attribute of each passing-through direction may be, for example, whether a vehicle travels along with a pedestrian at the same time, and whether the road where the passing-through direction is located is a main road. The attribute of each passing-through direction can be stored in the server in advance. When timing of the signal lights is required, the attribute of each communication direction at the target intersection where the signal lights are located are obtained to determine the corresponding a constraint according to an attribute of each passing-through direction.

In this embodiment, the constraint to each passing-through direction may be determined according to an attribute of each passing-through direction at the target intersection. For example, if the attribute of the passing-through direction is that vehicles and pedestrians travel at the same time, the restriction condition of the passing-through direction is the pedestrian crossing constraints. Moreover, if the attribute of the passing-through direction is a main road, the restriction condition of the passing-through direction is the trunk priority constraints.

In a possible implementation, determining the constraint to each passing-through direction according to an attribute of each passing-through direction at the target intersection includes: determining a minimum passing-through duration of a signal light corresponding to a first passing-through direction according to a width of the intersection in the first passing-through direction and a preset travelling speed of a pedestrian; and/or, determining a range of the passing-through duration of a signal light corresponding to a second passing-through direction, according to a type of the road along the second passing-through direction and the optimal passing-through duration of the signal light corresponding to the second passing-through direction; and/or, determining a sum of the passing-through durations of respective signal lights according to a signal-light adjustment cycle corresponding to the target intersection; and/or, determining a minimum passing-through duration of a signal light corresponding to a third passing-through direction according to a width of the intersection in the third passing-through direction and a speed limit for vehicles at the intersection.

The first passing-through direction refers to the passing-through direction that vehicles and pedestrians travel at the same time.

For a certain passing-through direction, when vehicles and pedestrians need to travel at the same time, it is necessary to ensure that the passing-through duration of the passing-through direction is long enough for the pedestrians to pass, then the minimum value of the final passing-through duration of the passing-through direction should not be less than the pedestrian crossing duration. Therefore, for the first passing-through direction through which the vehicle and the pedestrian travel simultaneously, the pedestrian crossing duration is determined according to the width of the intersection of the first passing-through direction and the preset travelling speed of a pedestrian, that is, the minimum passing-through duration of the signal light corresponding to the first passing-through direction is determined. The pedestrian crossing speed can be preset according to experience value.

Figure 3:
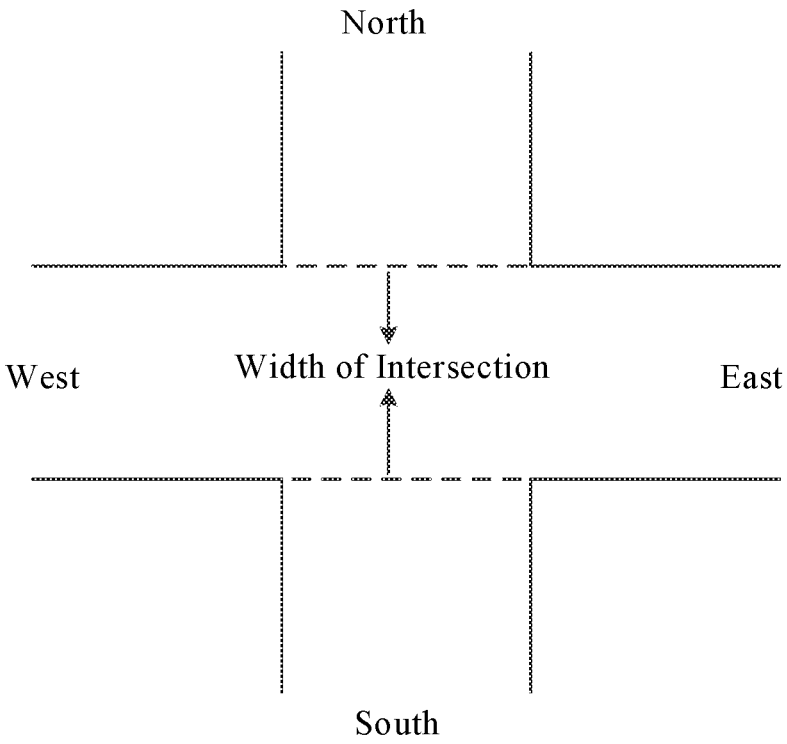
FIG. 3 is a graph of a width of the intersection.

In order to facilitate understanding of the width of the intersection in the first passing-through direction, the following description is made with reference to FIG. 3. FIG. 3 is an example of the width of the intersection. As illustrated in FIG. 3, for a crossroad, the attribute of north-south direction (including south-to-north and north-to-south) is that vehicles and pedestrians travel at the same time, then the distance between the two broken lines in FIG. 3 is the width of a north-south intersection.

In the embodiments of the present disclosure, the type of the road may include a main road, and an auxiliary road. Generally, due to the large traffic of the main road, when optimizing a main road as a whole, it is hoped that all intersections on the main road are assigned with long green light duration in the direction of the main road to achieve the highest capacity on the direction of the main road. Therefore, in the embodiments of the present disclosure, whether the type of the road is a main road can be used as a constraint. If the type of the road along the second passing-through direction is a main road, the range of the passing-through duration of the signal light corresponding to the second passing-through direction can be determined according to the optimal passing-through duration of the signal light corresponding to the second passing-through direction. For example, for the passing-through direction corresponding to the main road, the optimal passing-through duration determined according to the traffic is 60 seconds. In order to achieve the priority effect of the trunk, the green light duration needs to be increased by up to 30%, and the passing-through duration range of the signal light corresponding to the passing-through direction can be determined as 60~78.

Generally, the signal lights arranged at the intersection have a certain adjustment cycle. The adjustment cycle can be preset according to the actual situation of the intersection. The sum of the passing-through duration in all directions of the intersection should be equal to the adjustment cycle, that is, the sum of the passing-through duration in all directions of the target intersection satisfies a constraint to the period duration:

$$\sum_{i=1}^{n} p_i = C.$$

Here, C is the adjustment cycle of the signal lights, $p_i$ is the final passing-through duration of the i-th passing-through direction, n is the number of passing-through directions at the target intersection, and n is a positive integer.

It is understandable that the passing-through duration of each passing-through direction should ensure that at least one vehicle can pass. Therefore, in the embodiments of the present disclosure, the minimum passing-through duration of the signal light corresponding to the third passing-through direction can be determined according to the width of the intersection in the third passing-through direction and the speed limit of the vehicle at the traffic intersection. FIG. 3 is a graph of a width of the intersection. Therefore, by determining the minimum passing-through duration based on the width of the intersection and the speed limit for vehicles of the intersection, the minimum passing-through duration in each passing-through direction can be generated in a targeted manner, and the applicability and flexibility are strong.

It is noted that the first, second, and third passing-through directions may be the same passing-through direction, that is, for a passing-through direction, there may be a plurality of a constraint on the value of the final passing-through duration to achieve the best traffic state. In addition, in addition to the constraint listed above, there may be other constraint, which are not limited in this disclosure.

By determining the constraint to each passing-through direction according to factors such as type of the road, a width of the intersection, speed limit for vehicles, and pedestrian crossing speed, the foundation for determining the corresponding range of values for each variable according to the constraint is laid.

In the embodiments of the present disclosure, when determining the constraint in each passing-through direction according to the obtained configuration instruction, the user can configure the corresponding constraint according to the actual conditions of each passing-through direction. After user inputting is completed, the configuration instruction is generated, and the server obtains the configuration instruction to determine the constraint corresponding to each passing-through direction, thus the flexible setting of the constraint in each passing-through direction can be realized, which is beneficial to update or add the constraint to the passing-through direction.

At step 203, a range of values for each variable in a calibration function corresponding to the target intersection is determined according to a constraint to each passing-through direction at the target intersection, wherein the calibration function includes the optimal passing-through duration corresponding to each passing-through direction and a variable corresponding to a final passing-through duration in each passing-through direction.

In this embodiment, after the constraint to each passing-through direction are determined, the range of values for each variable in a calibration function corresponding to the target intersection can be determined according to the constraint to each passing-through direction.

For example, assuming that the minimum passing-through duration of a certain passing-through direction corresponding to a signal light is 20 seconds based on the width of the intersection and the preset travelling speed of a pedestrian, then the range of values for the variable corresponding to the final passing-through duration of the passing-through direction is greater than 20 seconds.

At step 204, the final passing-through duration in each passing-through direction in a case where the calibration function meets a preset condition is calculated according to the range of values for each variable.

In this embodiment, for the description of steps 203 to 204, reference may be made to the description of steps 102 to 103 in the foregoing embodiment, and no further details are provided here.

With the timing control method for a signal light according to embodiments of the present disclosure, an optimal passing-through duration of a signal light corresponding to each passing-through direction at a target intersection may be determined according to traffic in the passing-through direction. A range of values for each variable in a calibration function corresponding to the target intersection is determined according to a constraint to each passing-through direction at the target intersection, wherein the calibration function includes the optimal passing-through duration corresponding to each passing-through direction and a variable corresponding to a final passing-through duration in each passing-through direction. The final passing-through duration in each passing-through direction in a case where the calibration function meets a preset condition is calculated according to the range of values for each variable. Therefore, when it is determined the calibration function satisfies the preset conditions through the calibration function and the range of values for each variable in the calibration function determined according to the constraint, automatic timing of the final passing-through duration in each passing-through direction is realized based on the constraint, since there is no need to manually time the signal lights according to the constraint, labor costs are saved. Since the processing speed of the computer is much faster than manual processing speed, the solution of the present disclosure saves the time cost of signal light timing and improves the timing speed and efficiency, the solution of the present disclosure is not affected by artificial subjective factors. Compared with the manual timing method, it is beneficial to improve the accuracy of signal timing and provides conditions for the realization of intelligent transportation.

According to an embodiment of the present disclosure, the present disclosure also provides a timing control apparatus for a signal light.

Figure 4:
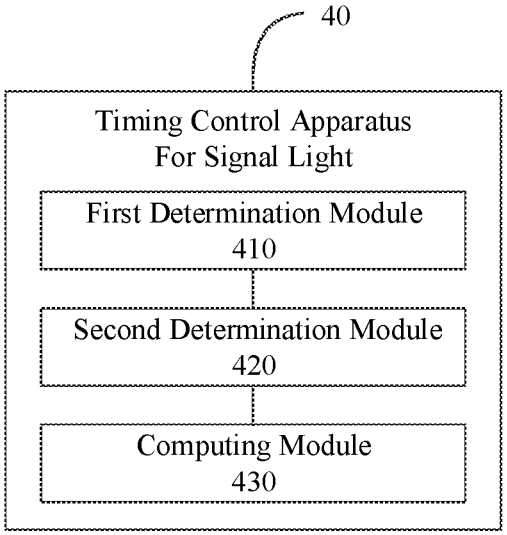
FIG. 4 is a schematic diagram of a timing control apparatus for a signal light according to a third embodiment of the present disclosure.

FIG. 4 is a schematic diagram of a timing control apparatus for a signal light according to a third embodiment of the present disclosure. As illustrated in FIG. 4, the apparatus for controlling signal light timing 40 includes: a first determination module 410, a second determination module 420, and a computing module 430.

The first determination module 410 is configured to determine an optimal passing-through duration of a signal light corresponding to each passing-through direction at a target intersection according to traffic in the passing-through direction.

In a possible implementation, the first determination module 410 is configured to determine the optimal passing-through duration of the signal light corresponding to each passing-through direction during a next time period adjacent to the current time period according to the traffic at the target intersection in each passing-through direction during the current time period; or, determine the optimal passing-through duration of the signal light corresponding to each passing-through direction during the next time period according to historical traffic in the passing-through direction at the target intersection during the next time period, wherein the next time period is a time period adjacent to the current time period.

By determining the optimal passing-through duration of the next time period based on the traffic of the current time period, or the optimal passing-through duration of the next time period based on the historical traffic of the next time period, the prediction of the optimal passing-through duration of the next time period is achieved to further determine the final passing-through duration of a next time period.

The second determination module 420 is configured to determine a range of values for each variable in a calibration function corresponding to the target intersection according to a constraint to each passing-through direction at the target intersection, wherein the calibration function includes the optimal passing-through duration corresponding to each passing-through direction and a variable corresponding to a final passing-through duration in each passing-through direction.

The computing module 430 is configured to calculate the final passing-through duration in each passing-through direction in a case where the calibration function meets a preset condition, according to the range of values for each variable.

In a possible implementation, the calibration function is configured to characterize a degree of difference between the final passing-through duration and the optimal passing-through duration in each passing-through direction, and the computing module 430 is further configured to calculate the final passing-through duration in each passing-through direction by minimizing the value of the calibration function.

By the final passing-through duration in each passing-through direction by minimizing the value of the calibration function, the difference between the final passing-through duration of each passing-through direction and the optimal passing-through duration is minimized, which guarantees the maximum traffic as much as possible on the basis of satisfying various a constraint, thus it is conducive to alleviating the traffic pressure in all passing-through directions and further improving the accuracy of signal timing.

Furthermore, the computing module 430 is further configured to determine a solution corresponding to a minimized degree of difference between the final passing-through duration and the optimal passing-through duration in each passing-through direction as the final passing-through duration in each passing-through direction when there are at least two sets of solutions correspond to the minimized value of the calibration function.

In a case where at least two sets of solutions correspond to the minimized value of the calibration function, a solution corresponding to a minimized degree of difference between the final passing-through duration and the optimal passing-through duration in each passing-through direction may be determined as the final passing-through duration in each passing-through direction. Accordingly, it is ensured that the final passing-through duration of each passing-through direction is close to the optimal passing-through duration, which further improves the accuracy of signal timing.

Figure 5:
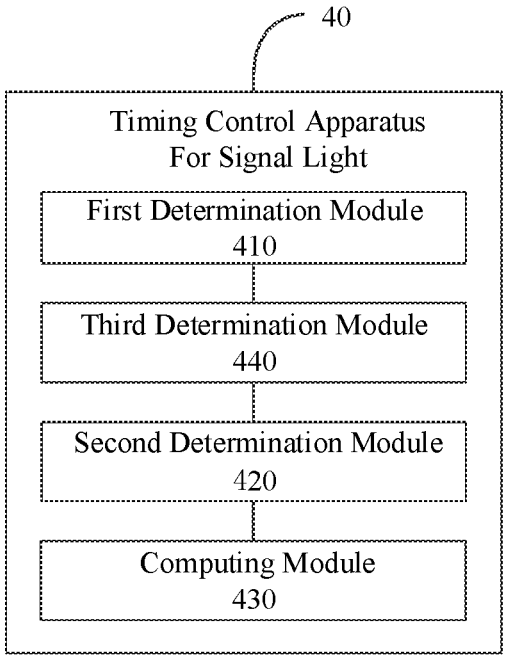
FIG. 5 is a schematic diagram of a timing control apparatus for a signal light according to a fourth embodiment of the present disclosure.

In a possible implementation, as illustrated in FIG. 5, based on FIG. 4, the apparatus for controlling signal light timing 40 further includes: a third determination module 440, configured to: determine the constraint to each passing-through direction according to an attribute of each passing-through direction at the target intersection; and/or, determine the constraint to each passing-through direction according to an acquired configuration instruction.

In a possible implementation, the third determination module 440 is further configured to: determine a minimum passing-through duration of a signal light corresponding to a first passing-through direction according to a width of the intersection in the first passing-through direction and a preset travelling speed of a pedestrian; and/or, determine a range of the passing-through duration of a signal light corresponding to a second passing-through direction, according to a type of the road along the second passing-through direction and the optimal passing-through duration of the signal light corresponding to the second passing-through direction; and/or, determine a sum of the passing-through durations of respective signal lights according to a signal-light adjustment cycle corresponding to the target intersection; and/or, determine a minimum passing-through duration of a signal light corresponding to a third passing-through direction according to a width of the intersection in the third passing-through direction and a speed limit for vehicles at the intersection.

Therefore, by determining the constraint in each passing-through direction according to factors such as a type of the road, a width of the intersection, a speed limit for vehicles, and a preset travelling speed of a pedestrian a foundation is laid for determining the corresponding range of values for each variable according to the constraint.

It is noted that the foregoing explanation and description of the timing control method for a signal light embodiment is also applicable for the apparatus for controlling signal light timing of the embodiment of the present disclosure, and its implementation principle is similar, which is not repeated herein.

With the apparatus for controlling signal light timing according to embodiments of the present disclosure, according to traffic at a target intersection in each passing-through direction, optimal passing-through duration of a signal light corresponding to each passing-through direction are determined. A range of values for each variable in a calibration function corresponding to the target intersection may be determined according to a constraint to each passing-through direction at the target intersection, wherein the calibration function comprises the optimal passing-through duration corresponding to each passing-through direction and a variable corresponding to a final passing-through duration in each passing-through direction. The final passing-through duration in each passing-through direction in a case where the calibration function meets a preset condition may be calculated according to the range of values for each variable. Therefore, when it is determined the calibration function satisfies the preset conditions through the calibration function and the range of values for each variable in the calibration function determined according to the constraint, automatic timing of the final passing-through duration in each passing-through direction is realized based on the constraint, since there is no need to manually time the signal lights according to the constraint, labor costs are saved. Since the processing speed of the computer is much faster than manual processing speed, the solution of the present disclosure saves the time cost of signal light timing and improves the timing speed and efficiency, the solution of the present disclosure is not affected by artificial subjective factors. Compared with the manual timing method, it is beneficial to improve the accuracy of signal timing and provides conditions for the realization of intelligent transportation.

According to the embodiments of the present disclosure, the present disclosure also provides an electronic device and a readable storage medium.

Figure 6:
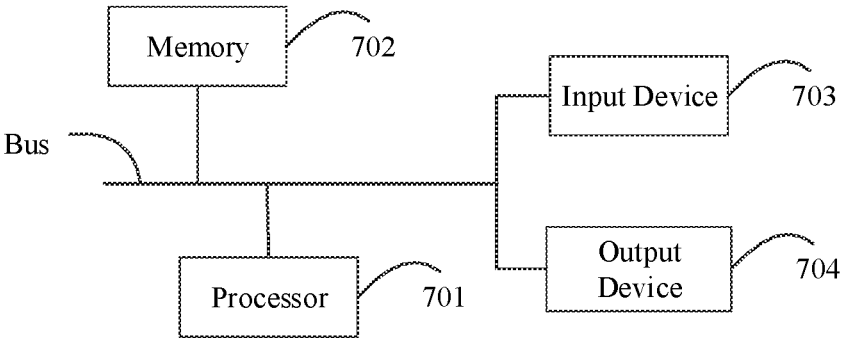
FIG. 6 is a block diagram of an electronic device for implementing a timing control method for a signal light according to an embodiment of the present disclosure.

FIG. 6 is a block diagram of an electronic device used to implement the method according to an embodiment of the present disclosure. Electronic devices are intended to represent various forms of digital computers, such as laptop computers, desktop computers, workbenches, personal digital assistants, servers, blade servers, mainframe computers, and other suitable computers. Electronic devices may also represent various forms of mobile devices, such as personal digital processing, cellular phones, smart phones, wearable devices, and other similar computing devices. The components shown here, their connections and relations, and their functions are merely examples, and are not intended to limit the implementation of the disclosure described and/or required herein.

As illustrated in FIG. 6, the electronic device includes: one or more processors 701, a memory 702, and interfaces for connecting various components, including a high-speed interface and a low-speed interface. The various components are interconnected using different buses and can be mounted on a common mainboard or otherwise installed as required. The processor may process instructions executed within the electronic device, including instructions stored in or on the memory to display graphical information of the GUI on an external input/output device such as a display device coupled to the interface. In other embodiments, a plurality of processors and/or buses can be used with a plurality of memories and processors, if desired. Similarly, a plurality of electronic devices can be connected, each providing some of the necessary operations (for example, as a server array, a group of blade servers, or a multiprocessor system). A processor 701 is taken as an example in FIG. 6.

The memory 702 is a non-transitory computer-readable storage medium according to the present disclosure. The memory stores instructions executable by at least one processor, so that the at least one processor executes the voice control method according to the present disclosure. The non-transitory computer-readable storage medium of the present disclosure stores computer instructions, which are used to cause a computer to execute the method according to the present disclosure.

As a non-transitory computer-readable storage medium, the memory 702 is configured to store non-transitory software programs, non-transitory computer executable programs and modules, such as program instructions/modules corresponding to the voice skill creation method in the embodiment of the present disclosure (For example, the first determination module 410, the second determination module 420, and the computing module 430 shown in FIG. 4). The processor 701 executes various functional applications and data processing of the server by running non-transitory software programs, instructions, and modules stored in the memory 702, that is, implementing the method in the foregoing method embodiment.

The memory 702 may include a storage program area and a storage data area, where the storage program area may store an operating system and application programs required for at least one function. The storage data area may store data created according to the use of the electronic device, and the like. In addition, the memory 702 may include a high-speed random access memory, and a non-transitory memory, such as at least one magnetic disk storage device, a flash memory device, or other non-transitory solid-state storage device. In some embodiments, the memory 702 may optionally include a memory remotely disposed with respect to the processor 701, and these remote memories may be connected to the electronic device through a network. Examples of the above network include, but are not limited to, the Internet, an intranet, a local area network, a mobile communication network, and combinations thereof.

The electronic device for implementing a timing control method for a signal light may further include an input device 703 and an output device 704. The processor 701, the memory 702, the input device 703, and the output device 704 may be connected through a bus or in other manners. In FIG. 6, the connection through the bus is taken as an example.

The input device 703 may receive inputted numeric or character information, and generate key signal inputs related to user settings and function control of an electronic device, such as a touch screen, a keypad, a mouse, a trackpad, a touchpad, an indication rod, one or more mouse buttons, trackballs, joysticks and other input devices. The output device 704 may include a display device, an auxiliary lighting device (for example, an LED), a haptic feedback device (for example, a vibration motor), and the like. The display device may include, but is not limited to, a liquid crystal display (LCD), a light emitting diode (LED) display, and a plasma display. In some embodiments, the display device may be a touch screen.

Various embodiments of the systems and technologies described herein may be implemented in digital electronic circuit systems, integrated circuit systems, application specific integrated circuits (ASICs), computer hardware, firmware, software, and/or combinations thereof. These various embodiments may be implemented in one or more computer programs, which may be executed and/or interpreted on a programmable system including at least one programmable processor. The programmable processor may be dedicated or general purpose programmable processor that receives data and instructions from a storage system, at least one input device, and at least one output device, and transmits the data and instructions to the storage system, the at least one input device, and the at least one output device.

These computing programs (also known as programs, software, software applications, or code) include machine instructions of a programmable processor and may utilize high-level processes and/or object-oriented programming languages, and/or assembly/machine languages to implement these calculation procedures. As used herein, the terms "machine-readable medium" and "computer-readable medium" refer to any computer program product, device, and/or device used to provide machine instructions and/or data to a programmable processor (for example, magnetic disks, optical disks, memories, programmable logic devices (PLDs), including machine-readable media that receive machine instructions as machine-readable signals. The term "machine-readable signal" refers to any signal used to provide machine instructions and/or data to a programmable processor.

In order to provide interaction with a user, the systems and techniques described herein may be implemented on a computer having a display device (e.g., a Cathode Ray Tube (CRT) or a Liquid Crystal Display (LCD) monitor for displaying information to a user); and a keyboard and pointing device (such as a mouse or trackball) through which the user can provide input to the computer. Other kinds of devices may also be used to provide interaction with the user. For example, the feedback provided to the user may be any form of sensory feedback (e.g., visual feedback, auditory feedback, or haptic feedback), and the input from the user may be received in any form (including acoustic input, voice input, or tactile input).

The systems and technologies described herein can be implemented in a computing system that includes background components (for example, a data server), or a computing system that includes middleware components (for example, an application server), or a computing system that includes front-end components (For example, a user computer with a graphical user interface or a web browser, through which the user can interact with the implementation of the systems and technologies described herein), or include such background components, intermediate computing components, or any combination of front-end components. The components of the system may be interconnected by any form or medium of digital data communication (egg, a communication network). Examples of communication networks include: local area network (LAN), wide area network (WAN), and the Internet.

The computer system may include a client and a server. The client and server are generally remote from each other and interacting through a communication network. The client-server relation is generated by computer programs running on the respective computers and having a client-server relation with each other.

It should be understood that the various forms of processes shown above can be used to reorder, add, or delete steps. For example, the steps described in this application can be executed in parallel, sequentially, or in different orders, as long as the desired results of the technical solutions disclosed in this application can be achieved, which is no limited herein.

The foregoing specific implementations do not constitute a limitation on the protection scope of the present application. It should be understood by those skilled in the art that various modifications, combinations, sub-combinations, and substitutions may be made according to design requirements and other factors. Any modification, equivalent replacement and improvement made within the spirit and principle of this application shall be included in the protection scope of this application.

What is claimed is:

1. A timing control method for a signal light, comprising:

determining an optimal passing-through duration of a signal light corresponding to each passing-through direction at a target intersection according to traffic in the passing-through direction;

determining a range of values for each variable in a calibration function corresponding to the target intersection according to a constraint to each passing-through direction at the target intersection, wherein the calibration function comprises the optimal passing-through duration corresponding to each passing-through direction and a variable corresponding to a final passing-through duration in each passing-through direction; and calculating the final passing-through duration in each passing-through direction in a case where the calibration function meets a preset condition, according to the range of values for each variable.

2. The method according to claim 1, wherein the calibration function is configured to characterize a degree of difference between the final passing-through duration and the optimal passing-through duration in each passing-through direction, and wherein calculating the final passing-through duration in each passing-through direction in a case where the calibration function meets a preset condition, comprises:

calculating the final passing-through duration in each passing-through direction by minimizing the value of the calibration function.

3. The method according to claim 2, further comprising:

determining a solution corresponding to a minimized degree of difference between the final passing-through duration and the optimal passing-through duration in each passing-through direction as the final passing-through duration in each passing-through direction, in a case where at least two sets of solutions correspond to the minimized value of the calibration function.

4. The method according to claim 3, wherein determining the optimal passing-through duration of the signal light corresponding to each passing-through direction at the target intersection according to the traffic in the passing-through direction, comprises:

determining the optimal passing-through duration of the signal light corresponding to each passing-through direction during a next time period adjacent to the current time period according to the traffic in the passing-through direction at the target intersection during the current time period; or, determining the optimal passing-through duration of the signal light corresponding to each passing-through direction during the next time period according to historical traffic in the passing-through direction at the target intersection during the next time period, wherein the next time period is a time period adjacent to the current time period.

5. The method according to claim 2, wherein determining the optimal passing-through duration of the signal light corresponding to each passing-through direction at the target intersection according to the traffic in the passing-through direction, comprises:

determining the optimal passing-through duration of the signal light corresponding to each passing-through direction during a next time period adjacent to the current time period according to the traffic in the passing-through direction at the target intersection during the current time period; or, determining the optimal passing-through duration of the signal light corresponding to each passing-through direction during the next time period according to historical traffic in the passing-through direction at the target intersection during the next time period, wherein the next time period is a time period adjacent to the current time period.

6. The method according to claim 1, further comprising:

determining the constraint to each passing-through direction according to an attribute of the passing-through direction at the target intersection; and/or, determining the constraint to each passing-through direction according to an acquired configuration instruction.

7. The method according to claim 6, wherein determining the constraint to each passing-through direction according to an attribute of the passing-through direction at the target intersection, comprises:

determining a minimum passing-through duration of the signal light corresponding to a first passing-through direction according to a width of the intersection in the first passing-through direction and a preset travelling speed of a pedestrian; and/or, determining a range of the passing-through duration of the signal light corresponding to a second passing-through direction, according to a type of the road along the second passing-through direction and the optimal passing-through duration of the signal light corresponding to the second passing-through direction; and/or, determining a sum of the passing-through durations of respective signal lights according to a signal-light adjustment cycle corresponding to the target intersection; and/or, determining a minimum passing-through duration of the signal light corresponding to a third passing-through direction according to the width of the intersection in the third passing-through direction and a speed limit for vehicles at the intersection.

8. The method according to claim 7, wherein determining the optimal passing-through duration of the signal light corresponding to each passing-through direction at the target intersection according to the traffic in the passing-through direction, comprises:

determining the optimal passing-through duration of the signal light corresponding to each passing-through direction during a next time period adjacent to the current time period according to the traffic in the passing-through direction at the target intersection during the current time period; or, determining the optimal passing-through duration of the signal light corresponding to each passing-through direction during the next time period according to historical traffic in the passing-through direction at the target intersection during the next time period, wherein the next time period is a time period adjacent to the current time period.

9. The method according to claim 4, wherein determining the optimal passing-through duration of the signal light corresponding to each passing-through direction at the target intersection according to the traffic in the passing-through direction, comprises:

determining the optimal passing-through duration of the signal light corresponding to each passing-through direction during a next time period adjacent to the current time period according to the traffic in the passing-through direction at the target intersection during the current time period; or, determining the optimal passing-through duration of the signal light corresponding to each passing-through direction during the next time period according to historical traffic in the passing-through direction at the target intersection during the next time period, wherein the next time period is a time period adjacent to the current time period.

10. The method according to claim 1, wherein determining the optimal passing-through duration of the signal light corresponding to each passing-through direction at the target intersection according to the traffic in the passing-through direction, comprises:

determining the optimal passing-through duration of the signal light corresponding to each passing-through direction during a next time period adjacent to the current time period according to the traffic in the passing-through direction at the target intersection during the current time period; or, determining the optimal passing-through duration of the signal light corresponding to each passing-through direction during the next time period according to historical traffic in the passing-through direction at the target intersection during the next time period, wherein the next time period is a time period adjacent to the current time period.

11. A timing control apparatus for a signal light, comprising:

one or more processors; and a storage device, configured to store one or more programs, wherein, when the one or more programs are executed by the one or more processors, the one or more processors are configured to implement a timing control method for a signal light, comprising:

determining an optimal passing-through duration of a signal light corresponding to each passing-through direction at a target intersection according to traffic in the passing-through direction;

determining a range of values for each variable in a calibration function corresponding to the target intersection according to a constraint to each passing-through direction at the target intersection, wherein the calibration function comprises the optimal passing-through duration corresponding to each passing-through direction and a variable corresponding to a final passing-through duration in each passing-through direction; and calculating the final passing-through duration in each passing-through direction in a case where the calibration function meets a preset condition, according to the range of values for each variable.

12. The apparatus according to claim 11, wherein the calibration function is configured to characterize a degree of difference between the final passing-through duration and the optimal passing-through duration in each passing-through direction, and the one or more processors is further configured to calculate the final passing-through duration in each passing-through direction by minimizing the value of the calibration function.

13. The apparatus according to claim 12, wherein the one or more processors is further configured to:

determine a solution corresponding to a minimized degree of difference between the final passing-through duration and the optimal passing-through duration in each passing-through direction as the final passing-through duration in each passing-through direction, in a case where at least two sets of solutions correspond to the minimized value of the calibration function.

14. The apparatus according to claim 11, wherein the one or more processors is further configured to:

determine the constraint to each passing-through direction according to an attribute of the passing-through direction at the target intersection; and/or, determine the constraint to each passing-through direction according to an acquired configuration instruction.

15. The apparatus according to claim 14, wherein the one or more processors is further configured to:

determine a minimum passing-through duration of the signal light corresponding to a first passing-through direction according to a width of the intersection in the first passing-through direction and a preset travelling speed of a pedestrian; and/or, determine a range of the passing-through duration of the signal light corresponding to a second passing-through direction, according to a type of the road along the second passing-through direction and the optimal passing-through duration of the signal light corresponding to the second passing-through direction; and/or, determine a sum of the passing-through durations of respective signal lights according to a signal-light adjustment cycle corresponding to the target intersection; and/or, determine a minimum passing-through duration of the signal light corresponding to a third passing-through direction according to the width of the intersection in the third passing-through direction and a speed limit for vehicles at the intersection.

16. The apparatus according to claim 11, wherein the one or more processors is further configured to:

determine the optimal passing-through duration of the signal light corresponding to each passing-through direction during a next time period adjacent to the current time period according to the traffic in the passing-through direction at the target intersection during the current time period; or, determine the optimal passing-through duration of the signal light corresponding to each passing-through direction during the next time period according to historical traffic in the passing-through direction at the target intersection during the next time period, wherein the next time period is a time period adjacent to the current time period.

17. A tangible, non-transitory computer-readable storage medium storing computer instructions, wherein when the computer instructions are executed, the computer is caused to implement a timing control method for a signal light, comprising:

determining an optimal passing-through duration of a signal light corresponding to each passing-through direction at a target intersection according to traffic in the passing-through direction;

determining a range of values for each variable in a calibration function corresponding to the target intersection according to a constraint to each passing-through direction at the target intersection, wherein the calibration function comprises the optimal passing-through duration corresponding to each passing-through direction and a variable corresponding to a final passing-through duration in each passing-through direction; and calculating the final passing-through duration in each passing-through direction in a case where the calibration function meets a preset condition, according to the range of values for each variable.

18. The tangible, non-transitory computer-readable storage medium according to claim 17, wherein the calibration function is configured to characterize a degree of difference between the final passing-through duration and the optimal passing-through duration in each passing-through direction, and wherein, calculating the final passing-through duration in each passing-through direction when the calibration function meets the preset condition, comprises:

calculating the final passing-through duration in each passing-through direction by minimizing the value of the calibration function.

19. The tangible, non-transitory computer-readable storage medium according to claim 18, wherein the method further comprises:

determining a solution corresponding to a minimized degree of difference between the final passing-through duration and the optimal passing-through duration in each passing-through direction as the final passing-through duration in each passing-through direction, in a case where at least two sets of solutions correspond to the minimized value of the calibration function.

20. The tangible, non-transitory computer-readable storage medium according to claim 17, wherein the method further comprises:

determining the constraint to each passing-through direction according to an attribute of the passing-through direction at the target intersection; and/or, determining the constraint to each passing-through direction according to an acquired configuration instruction.

* * * * *